US012601107B2

(12) United States Patent
Lin et al.

(10) Patent No.: US 12,601,107 B2
(45) Date of Patent: Apr. 14, 2026

(54) ENVIRONMENTAL-FRIENDLY ARTIFICIAL LEATHER AND MANUFACTURING METHOD THEREOF

(71) Applicant: SAN FANG CHEMICAL INDUSTRY CO., LTD., Kaohsiung (TW)

(72) Inventors: Chih-Yi Lin, Kaohsiung City (TW); Kuo-Kuang Cheng, Kaohsiung City (TW); Yung-Yu Fu, Kaohsiung City (TW); Wei-Jie Liao, Kaohsiung City (TW); Kao-Lung Yang, Kaohsiung City (TW)

(73) Assignee: SAN FANG CHEMICAL INDUSTRY CO., LTD., Kaohsiung City (TW)

( * ) Notice: Subject to any disclaimer, the term of this patent is extended or adjusted under 35 U.S.C. 154(b) by 50 days.

(21) Appl. No.: 18/382,167

(22) Filed: Oct. 20, 2023

(65) Prior Publication Data

US 2024/0044072 A1 Feb. 8, 2024

Related U.S. Application Data

(62) Division of application No. 16/533,664, filed on Aug. 6, 2019, now abandoned.

(30) Foreign Application Priority Data

Aug. 8, 2018 (TW) ..... 107127626

(51) Int. Cl.

| | |
|---|---|
| ***D06N 3/00*** | (2006.01) |
| ***D04H 5/06*** | (2006.01) |
| ***D06N 3/14*** | (2006.01) |

(52) U.S. Cl.

CPC ..... *D06N 3/0013* (2013.01); *D04H 5/06* (2013.01); *D06N 3/0009* (2013.01); *D06N 3/0011* (2013.01); *D06N 3/14* (2013.01); *D06N 2211/28* (2013.01)

(58) Field of Classification Search

CPC ..... D06N 3/0013

See application file for complete search history.

(56) References Cited

U.S. PATENT DOCUMENTS 3,647,594 A * 3/1972 Demme et al. ..... B32B 37/12 428/327
3,849,241 A * 11/1974 Butin ..... D01D 5/0985 428/137
4,146,663 A * 3/1979 Ikeda ..... D06N 3/0006 28/162

FOREIGN PATENT DOCUMENTS

WO WO-95/03443 A1 * 2/1995

OTHER PUBLICATIONS

JP2014198926A—English translation and original document, published Oct. 23, 2014 (Year: 2014).*

* cited by examiner

*Primary Examiner* — Jennifer A Boyd
(74) *Attorney, Agent, or Firm* — WPAT, PC

(57) ABSTRACT

The present disclosure is relates to an environmental-friendly artificial leather and a method of manufacturing the same. The manufacturing method of the environmental-friendly artificial leather includes steps in which a first fiber web is formed by meltblown. The method continues with step in which a filament fabric is disposed on the first fiber web. The method continues with step in which a second fiber web is meltblown on the filament fabric, so as to form a multilayer fiber structure. The method continues with step in which the multilayer fiber structure is heat pressed to form the environmental-friendly artificial leather.

4 Claims, 12 Drawing Sheets

ENVIRONMENTAL-FRIENDLY ARTIFICIAL LEATHER AND MANUFACTURING METHOD THEREOF

FIELD

The disclosure relates to an artificial leather and manufacturing method thereof, more particular to an environmental-friendly artificial leather and manufacturing method thereof.

BACKGROUND

In the prior art, a multilayer artificial leather is universally manufactured by using a plurality of different manufacturing processes, and solvents need to be used in some manufacturing processes, for example, manufacturing processes that include resin impregnation or fiber dissolving and removing. However, the foregoing manufacturing method makes a manufacturing process more complex, and does not meet a requirement for environmental protection.

SUMMARY OF THE INVENTION

In accordance with one aspect of the present disclosure, an environmental-friendly artificial leather includes a first fiber web, a filament fabric and a second fiber web. The first fiber web is a meltblown fiber web. The filament fabric is disposed on the first fiber web. The second fiber web is disposed on the filament fabric, and the second fiber web is a meltblown fiber web.

In accordance with another aspect of the present disclosure, a manufacturing method of an environmental-friendly artificial leather includes step in which a first fiber web is formed by meltblown. The method continues with step in which a filament fabric is disposed on the first fiber web. The method continues with step in which a second fiber web is meltblown on the filament fabric to form a multilayer fiber structure. The method continues with step in which the multilayer fiber structure is heat pressed to form the environmental-friendly artificial leather.

In accordance with another aspect of the present disclosure, an environmental-friendly artificial leather includes a filament fabric, a first fiber web and a second fiber web. The first fiber web is disposed on the filament fabric, and the first fiber web is a meltblown fiber web. The second fiber web is disposed on the first fiber web, and the second fiber web is a meltblown fiber web.

In accordance with another aspect of the present disclosure, a manufacturing method of an environmental-friendly artificial leather includes step in which a filament fabric is provided. The method continues with step in which a first fiber web is meltblown on the filament fabric. The method continues with step in which a second fiber web is meltblown on the first fiber web to form a multilayer fiber structure. The method continues with step in which the multilayer fiber structure is heat pressed to form the environmental-friendly artificial leather.

BRIEF DESCRIPTION OF THE DRAWINGS

Aspects of the present disclosure are understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF THE INVENTION

Figure 1:
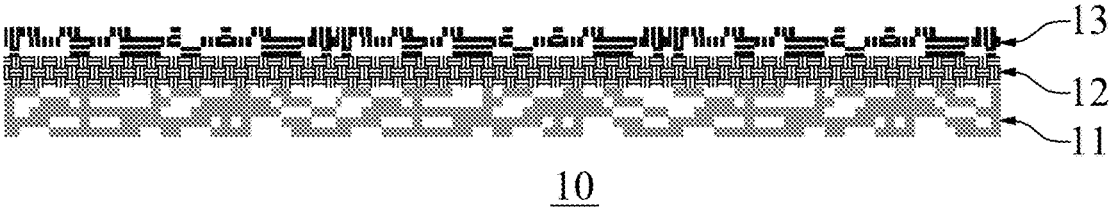
FIG. 1 shows a schematic structural view of an environmental-friendly artificial leather according to a first embodiment of the present disclosure.

It is to be understood that the following disclosure provides many different embodiments or examples, for implementing different features of various embodiments. Specific examples of components and arrangements are described below to simplify the present disclosure. The present disclosure may, however, be embodied in many different forms and should not be construed as being limited to the embodiments set forth herein; rather, these embodiments are provided so that this description will be thorough and complete, and will fully convey the present disclosure to those of ordinary skill in the art. It will be apparent, however, that one or more embodiments may be practiced without these specific details.

In addition, the present disclosure may repeat reference numerals and/or letters in the various examples. This repetition is for the purpose of simplicity and clarity and does not in itself dictate a relationship between the various embodiments and/or configurations discussed.

It will be understood that when an element is referred to as being "on" another element, it can be directly on the other element or intervening elements may be present. In contrast, when an element is referred to as being "directly on" another element, there are no intervening elements present.

It will be understood that singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms; such as those defined in commonly used dictionaries, should be interpreted as having a meaning that is consistent with their meaning in the context of the relevant art and the present disclosure, and will not be interpreted in an idealized or overly formal sense unless expressly so defined herein.

Referring to FIG. 1, which shows a schematic structural view of an environmental-friendly artificial leather according to a first embodiment of the present disclosure. The environmental-friendly artificial leather 10 in the first embodiment of the present disclosure includes a first fiber web 11, a filament fabric 12, and a second fiber web 13.

In some embodiments, the first fiber web 11 is a meltblown fiber web, and a material of the first fiber web 11 is thermoplastic polyurethane (TPU). Preferably, a Shore hardness of the TPU is greater than 60A and less than 40D. When the Shore hardness is greater than 40D, the hardness of the TPU is excessively high, and therefore, a completed composite structure sheet is excessively hard, delivers paper like touch, and does not deliver artificial leather touch. When the Shore hardness is less than 60A, a physical property apparently degrades because the TPU is excessively soft.

In addition, to enable the environmental-friendly artificial leather 10 to deliver good hand feel of an imitation leather, a fiber fineness of the first fiber web 11 should be controlled to be 1 to 6 deniers, and a thickness of the first fiber web 11 should be controlled to be 0.3 to 1.0 mm.

The filament fabric 12 is disposed on the first fiber web 11. In some embodiments, the filament fabric 12 can be manufactured through warp knitting, weft knitting, knitting, or tatting, and preferably, a material of the filament fabric 12 is thermoplastic polyurethane (TPU).

Furthermore, to enable the environmental-friendly artificial leather 10 to achieve high physical properties (to be specific, a high tensile strength and high tearing strength), a fiber fineness of the filament fabric 12 should be controlled to be 20 to 600 deniers.

The second fiber web 13 is disposed on the filament fabric 12. In some embodiments, the second fiber web 13 is a meltblown fiber web, and a material of the second fiber web 13 is thermoplastic polyurethane (TPU). Preferably, a Shore hardness of the TPU is greater than 80A and less than 65D. When the Shore hardness is greater than 65D, the hardness of the TPU is excessively high, and therefore, when grinding and teasing are performed, hairiness is excessively stiff, and does not deliver artificial leather touch. When the Shore hardness is less than 80A, there is no grinding property because the TPU is excessively soft.

Figure 2:
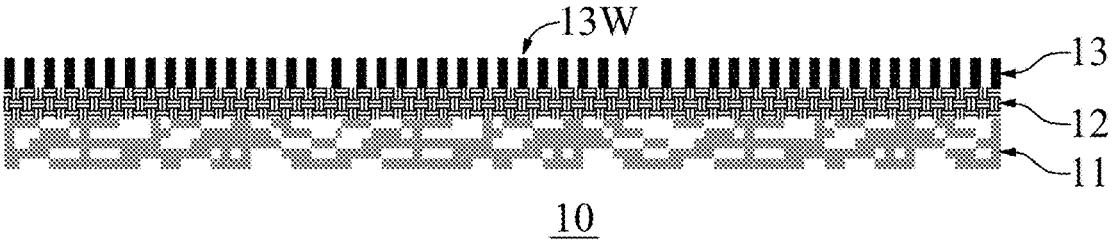
FIG. 2 shows a schematic view of a second fiber web with a teasing structure of an environmental-friendly artificial leather according to a first embodiment of the present disclosure.

FIG. 2 shows a schematic view of a second fiber web with a teasing structure of an environmental-friendly artificial leather according to a first embodiment of the present disclosure. With reference to FIG. 1 and FIG. 2, to enable the environmental-friendly artificial leather 10 to deliver hand feel of a teasing leather, surface grinding can be performed on the second fiber web 13 to form a teasing structure 13W.

In addition, to enable the teasing structure 13W of the second fiber web 13 to satisfy a fine hairiness requirement, a fiber fineness of the second fiber web 13 should be controlled to be 0.05 to 3 deniers, and a thickness of the second fiber web 13 should be controlled to be 0.3 to 1.0 mm.

Figure 3:
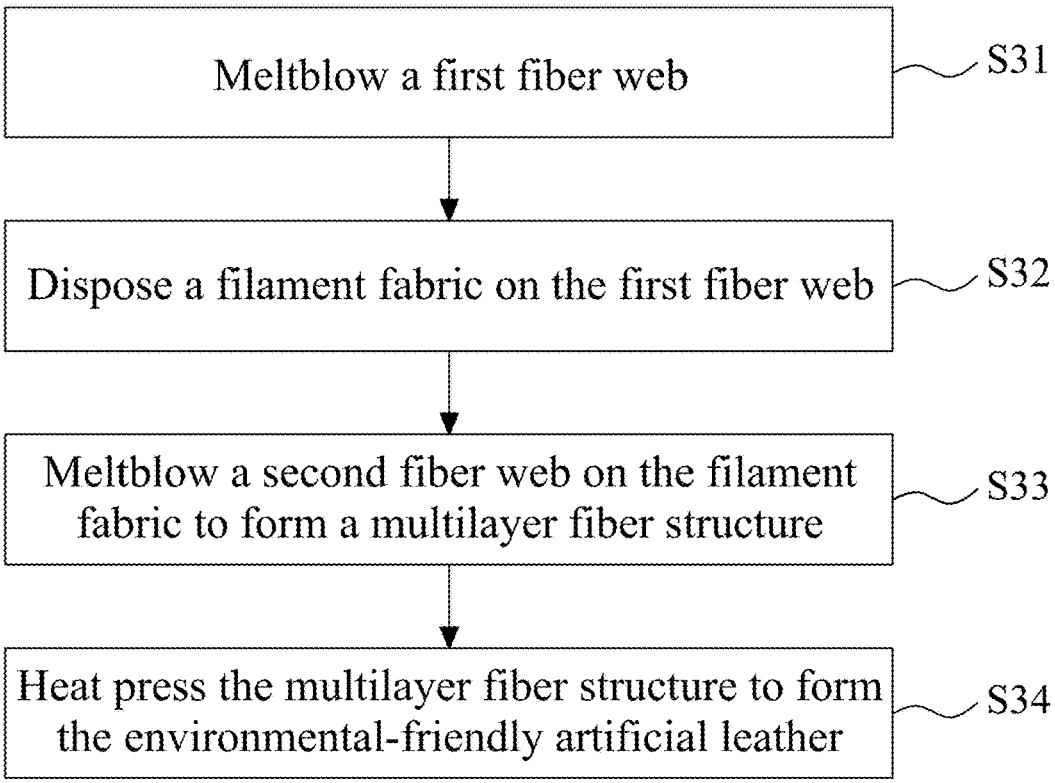
FIG. 3 shows a flow diagram of a manufacturing method of an environmental-friendly artificial leather according to a first embodiment of the present disclosure.

FIG. 3 shows a flow diagram of a manufacturing method of an environmental-friendly artificial leather according to a first embodiment of the present disclosure. FIGS. 4A to 4E are schematic views respectively showing respective steps in a manufacturing method of an environmental-friendly artificial leather according to a first embodiment of the present disclosure. With reference to step S31 in FIG. 3 and FIG. 4A, a first fiber web 11 is formed by meltblown. In some embodiments, the step of meltblowing the first fiber web 11 includes the following steps.

Step 1: Put TPU particles X1 into an extruder E1 for melting, and blow the melted TPU out by using a meltblown die head M1 and pressurized air, to form TPU fibers. Preferably, the temperature of the meltblown die head M1 is 210 to 250° C., and the air pressure and the air temperature of the pressurized air are respectively 3 to 8 kgf/cm$^2$ and 210 to 240° C.

Step 2: Pile up the TPU fibers into a web by using a hole conveyor belt C, and release high-speed wind pressure by using the hole conveyor belt C, to form the first fiber web 11.

Figure 4A:
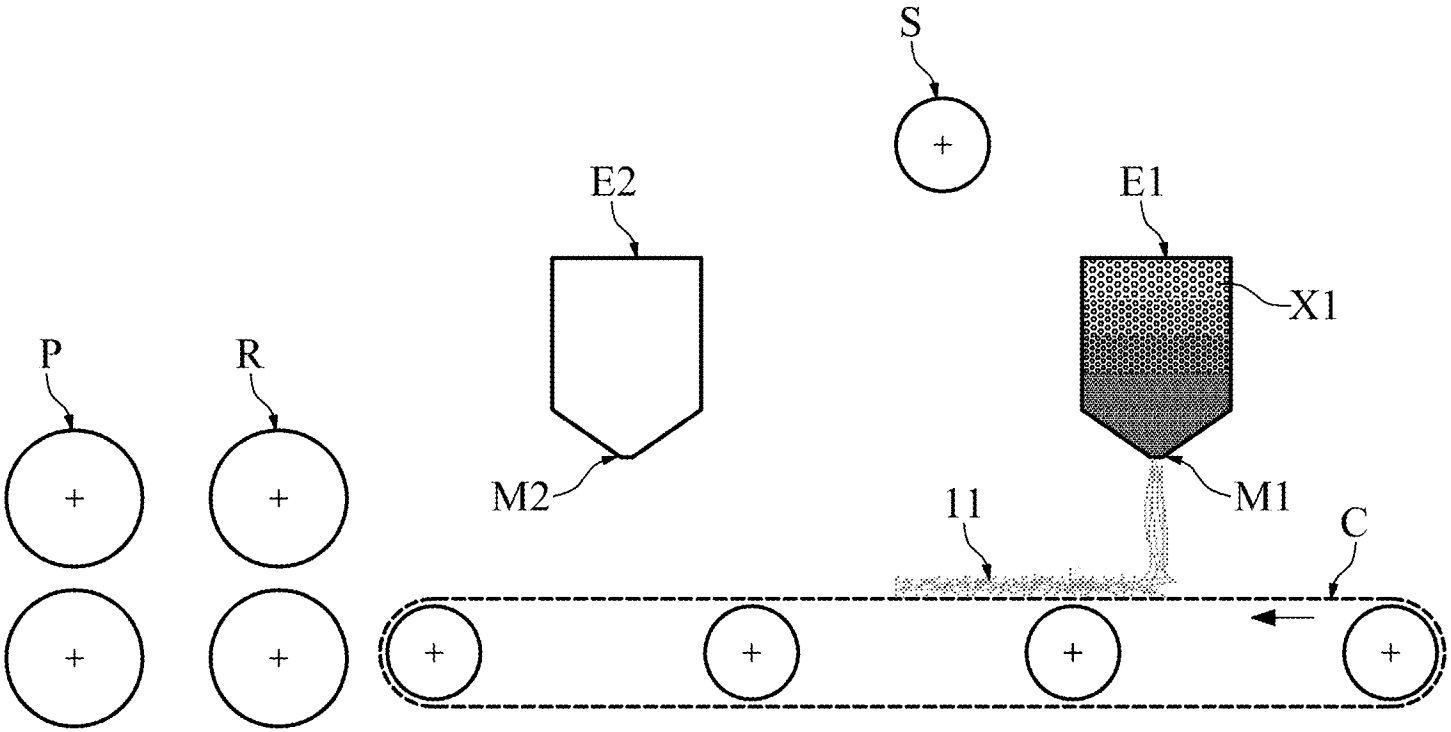
FIGS. 4A to 4E are schematic views respectively showing respective steps in a manufacturing method of an environmental-friendly artificial leather according to a first embodiment of the present disclosure.
Figure 4B:
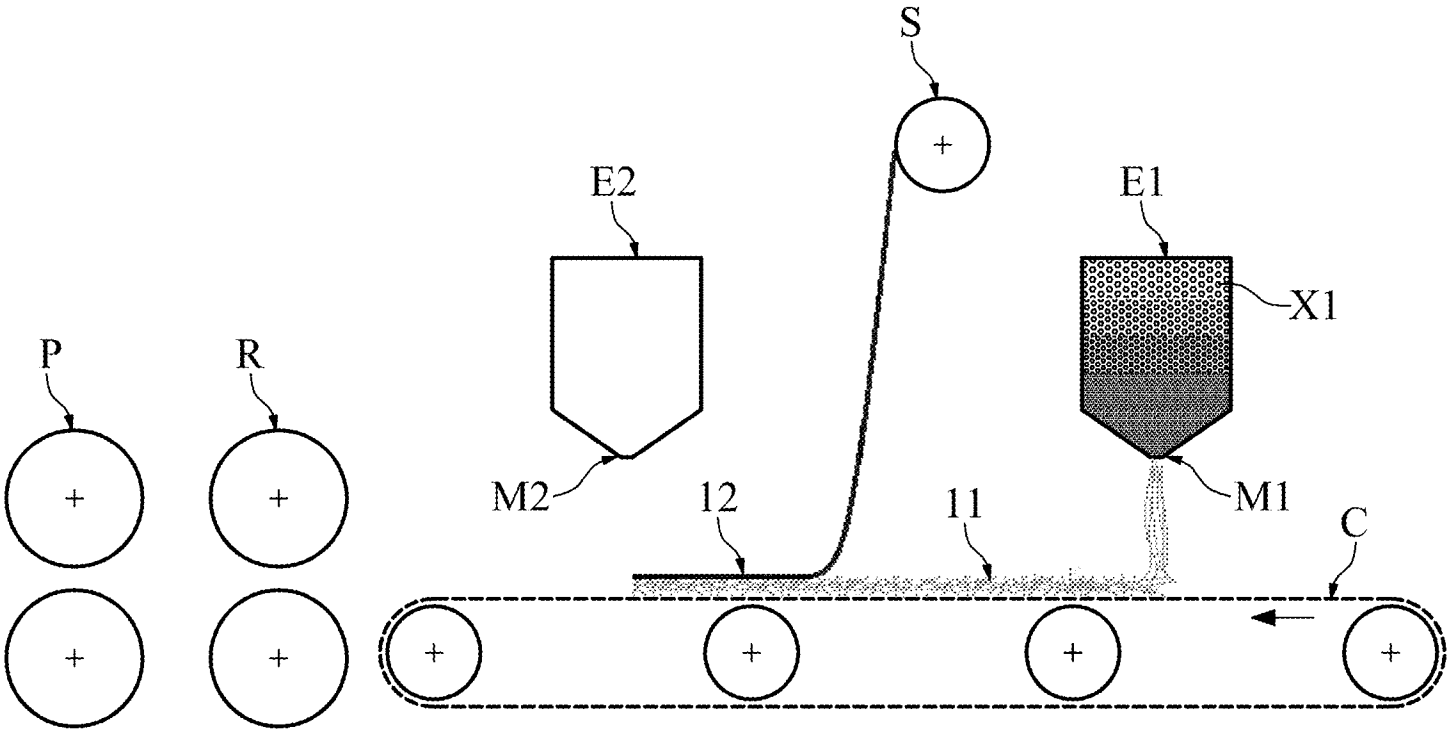

With reference to step S32 in FIG. 3 and FIG. 4B, a filament fabric 12 is disposed on the first fiber web 11. This step includes putting the filament fabric 12 onto the first fiber web 11 by using a conveying wheel S.

In some embodiments, the filament fabric 12 is woven by using TPU filaments, and the weaving method can be warp knitting, weft knitting, knitting, or tatting.

Figure 4C:
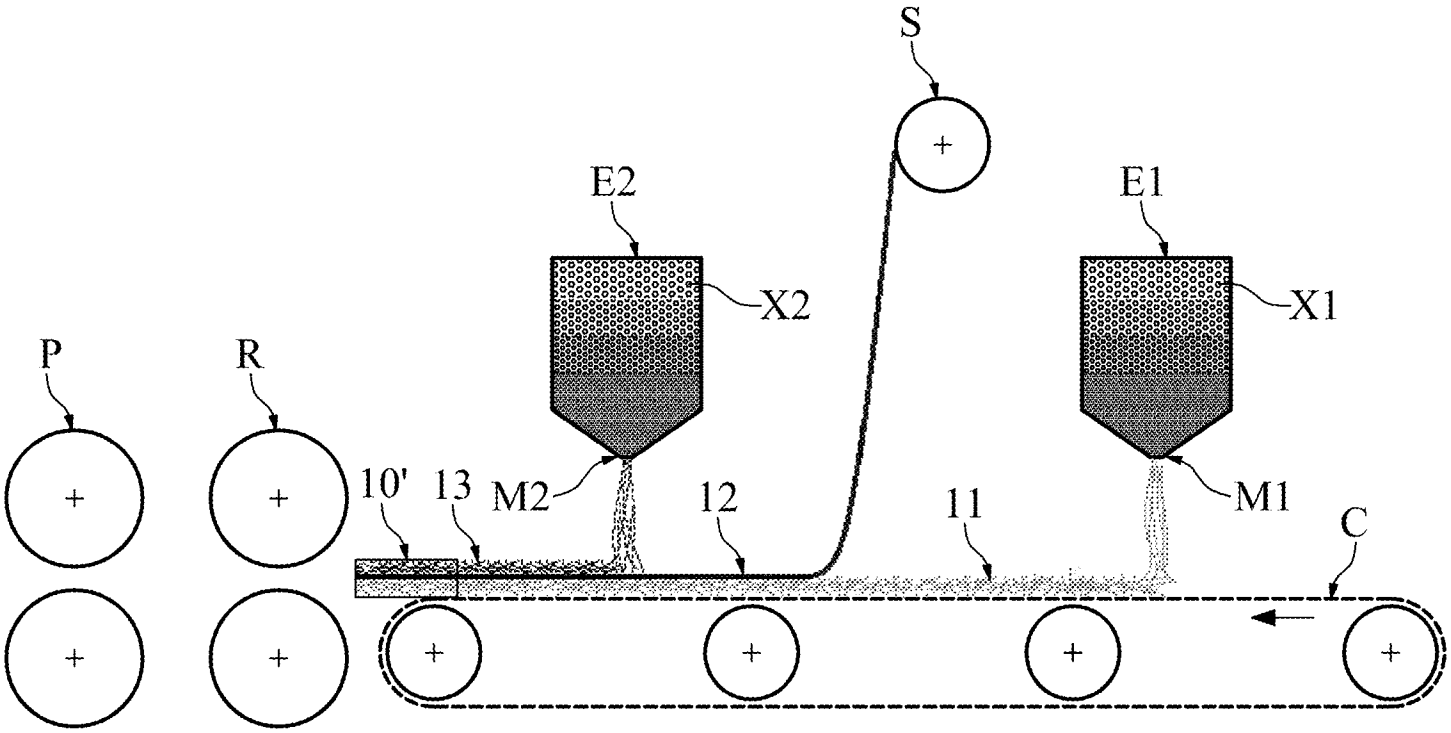

With reference to step S33 in FIG. 3 and FIG. 4C, a second fiber web 13 is meltblown on the filament fabric 12 to form a multilayer fiber structure 10'. In some embodiments, the step of meltblowing the second fiber web 13 includes the following steps.

Step 1: Put TPU particles X2 into an extruder E2 for melting, and blow the melted TPU out by using a meltblown die head M2 and pressurized air, to form TPU fibers. Preferably, the temperature of the meltblown die head M2 is 220 to 260° C., and the air pressure and the air temperature of the pressurized air are respectively 3 to 8 kgf/cm$^2$ and 220 to 250° C.

Step 2: Pile up the TPU fibers into a web by using the hole conveyor belt C, and release high-speed wind pressure by using the hole conveyor belt C, to form the second fiber web 13.

Figure 4D:
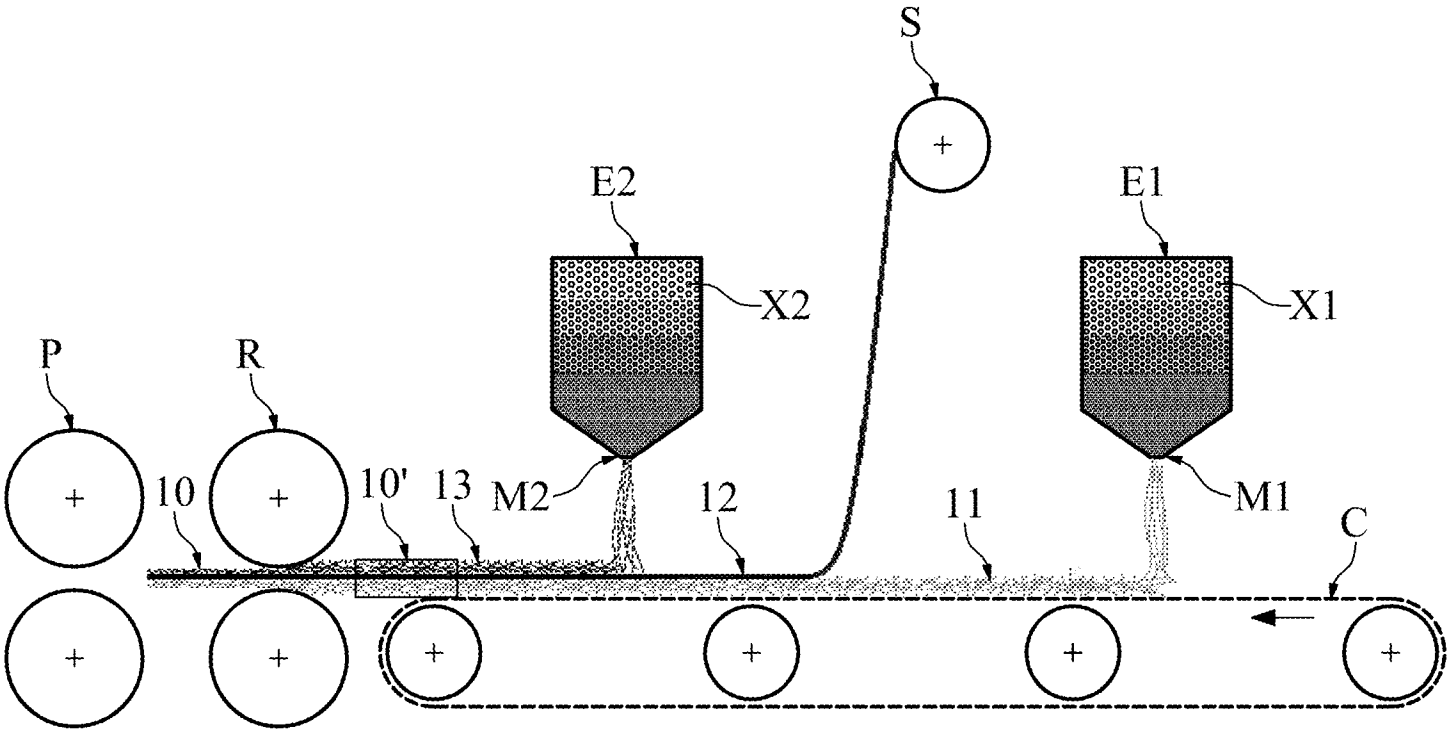

With reference to step S34 in FIG. 3 and FIG. 4D, the multilayer fiber structure 10' is heat pressed to form the environmental-friendly artificial leather 10. This step includes heat pressing the multilayer fiber structure 10' by using a heat pressing wheel R, and preferably, the temperature of the heat pressing wheel R is 130 to 160° C.

Figure 4E:
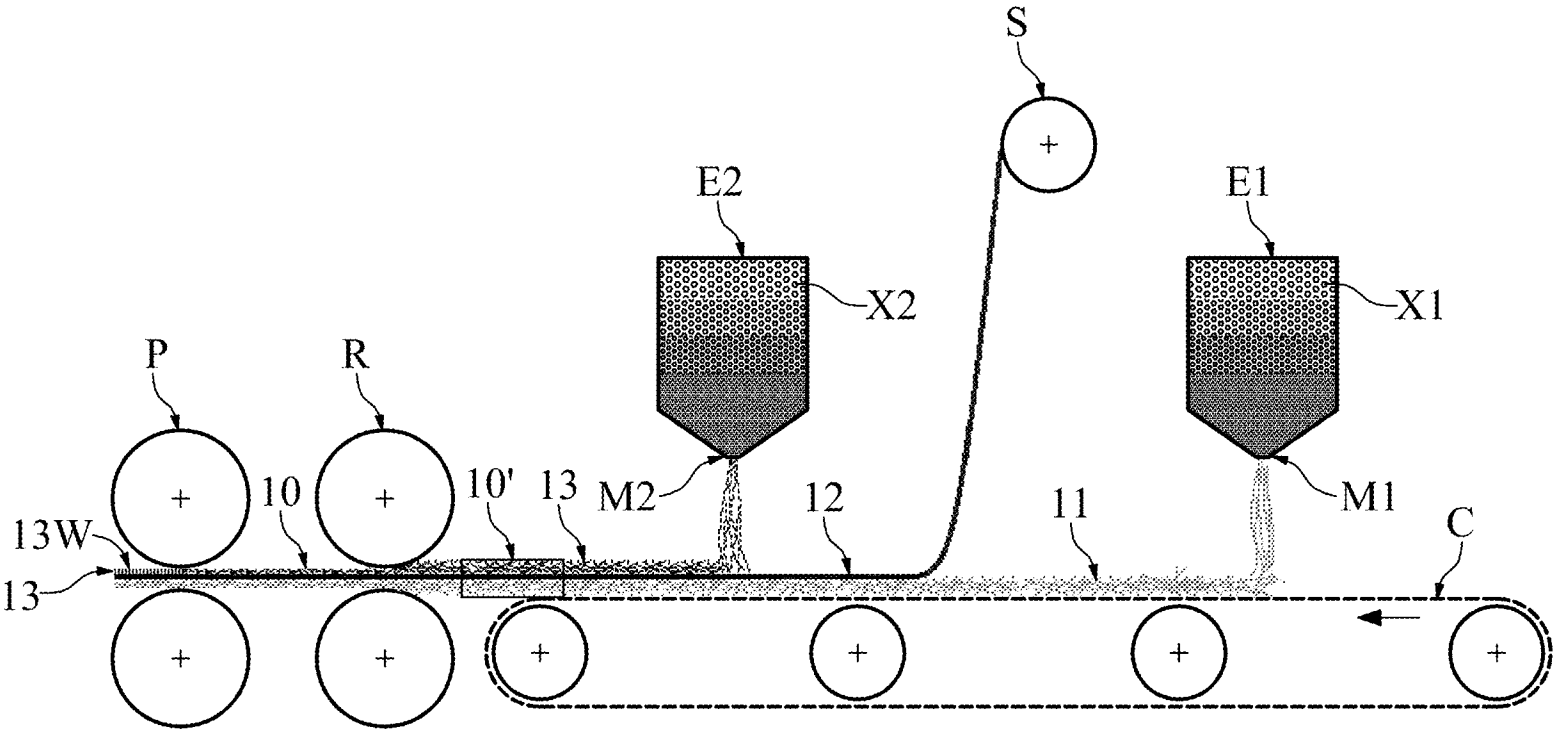

Referring to FIG. 4E, after the environmental-friendly artificial leather 10 is manufactured, surface grinding can be performed on the second fiber web 13 of the environmental-friendly artificial leather 10 by using a grinding machine P, so that the fibers of the second fiber web 13 locally break to form the teasing structure 13W, and the environmental-friendly artificial leather 10 delivers the hand feel of the teasing leather.

Figure 5:
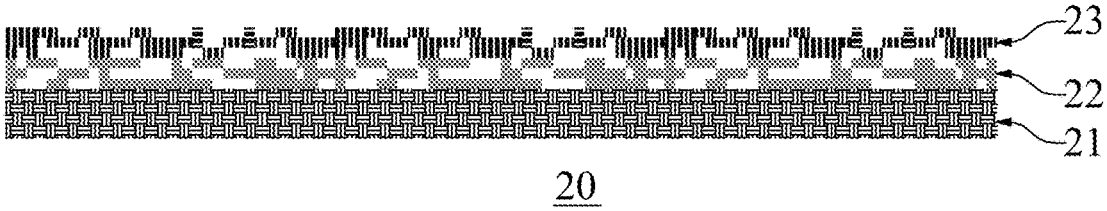
FIG. 5 shows a schematic structural view of an environmental-friendly artificial leather according to a second embodiment of the present disclosure.

Referring to FIG. 5, which shows a schematic structural view of an environmental-friendly artificial leather according to a second embodiment of the present disclosure. The environmental-friendly artificial leather 20 in the second embodiment of the present disclosure includes a filament fabric 21, a first fiber web 22, and a second fiber web 23.

In some embodiments, the filament fabric 21 can be manufactured through warp knitting, weft knitting, knitting, or tatting, and preferably, a material of the filament fabric 21 is thermoplastic polyurethane (TPU).

Furthermore, to enable the environmental-friendly artificial leather 20 to achieve high physical properties (to be specific, a high tensile strength and high tearing strength), a fiber fineness of the filament fabric 21 should be controlled to be 20 to 600 deniers.

The first fiber web 22 is disposed on the filament fabric 21. In some embodiments, the first fiber web 22 is a meltblown fiber web, and a material of the first fiber web 22 is thermoplastic polyurethane (TPU). Preferably, a Shore hardness of the TPU is greater than 60A and less than 40D. When the Shore hardness is greater than 40D, the hardness of the TPU is excessively high, and therefore, a completed composite structure sheet is excessively hard, delivers paper like touch, and does not deliver artificial leather touch. When the Shore hardness is less than 60A, a physical property apparently degrades because the TPU is excessively soft.

In addition, to enable the environmental-friendly artificial leather 20 to deliver good hand feel of an imitation leather, a fiber fineness of the first fiber web 22 should be controlled to be 1 to 6 deniers, and a thickness of the first fiber web 22 should be controlled to be 0.3 to 1.0 mm.

The second fiber web 23 is disposed on the first fiber web 22. In some embodiments, the second fiber web 23 is a meltblown fiber web, and a material of the second fiber web 23 is thermoplastic polyurethane (TPU). Preferably, a Shore hardness of the TPU is greater than 80A and less than 65D. When the Shore hardness is greater than 65D, the hardness of the TPU is excessively high, and therefore, when grinding and teasing are performed, hairiness is excessively stiff, and does not deliver artificial leather touch. When the Shore hardness is less than 80A, there is no grinding property because the TPU is excessively soft.

Figure 6:
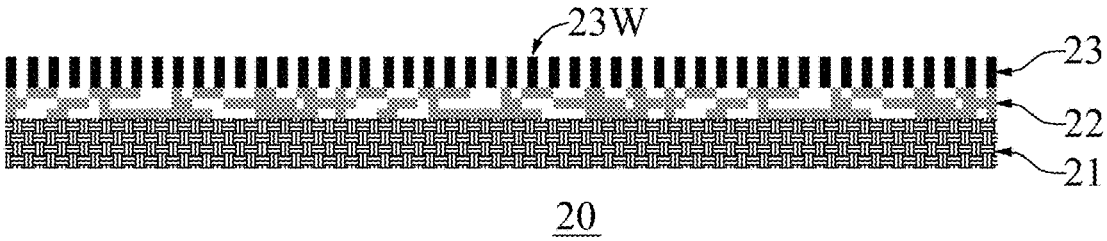
FIG. 6 shows a schematic view of a second fiber web with a teasing structure of an environmental-friendly artificial leather according to a second embodiment of the present disclosure.

FIG. 6 shows a schematic view of a second fiber web with a teasing structure of an environmental-friendly artificial leather according to a second embodiment of the present disclosure. With reference to FIG. 5 and FIG. 6, to enable the environmental-friendly artificial leather 20 to deliver hand feel of a teasing leather, surface grinding can be performed on the second fiber web 23 to form a teasing structure 23W.

In addition, to enable the teasing structure 23W of the second fiber web 23 to satisfy a fine hairiness requirement, a fiber fineness of the second fiber web 23 should be controlled to be 0.05 to 3 deniers, and a thickness of the second fiber web 23 should be controlled to be 0.3 to 1.0 mm.

Figure 7:
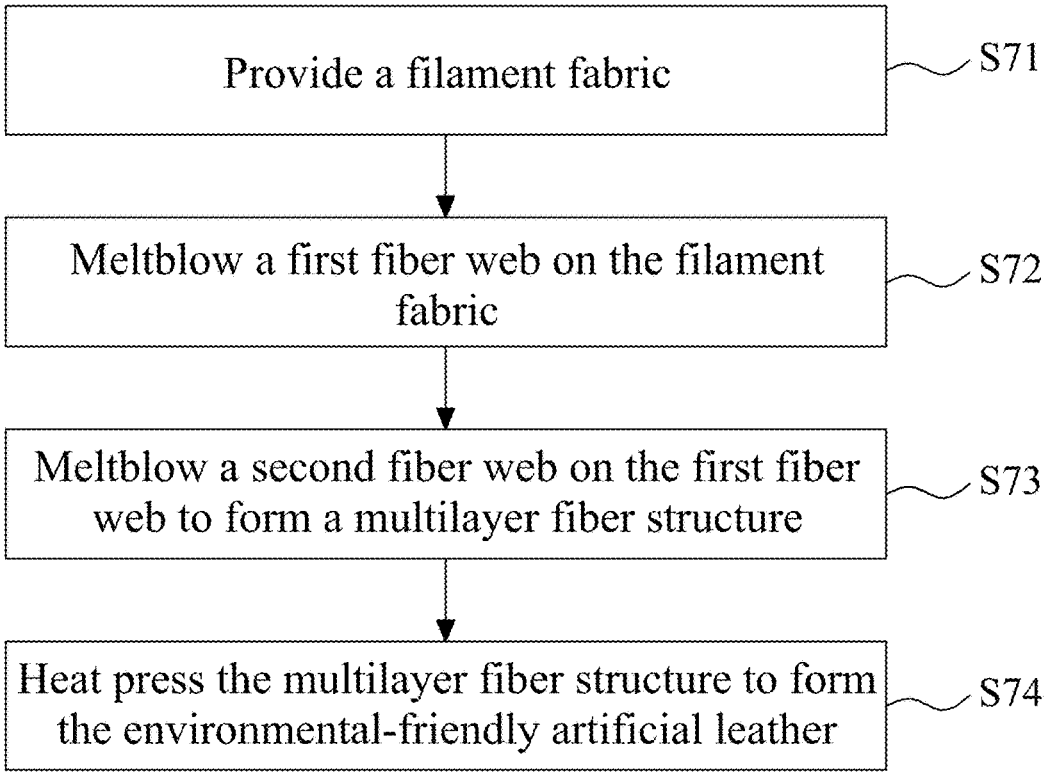
FIG. 7 shows a flow diagram of a manufacturing method of an environmental-friendly artificial leather according to a second embodiment of the present disclosure.

FIG. 7 shows a flow diagram of a manufacturing method of an environmental-friendly artificial leather according to a second embodiment of the present disclosure. FIGS. 8A to 8E are schematic views respectively showing respective steps in a manufacturing method of an environmental-friendly artificial leather according to a second embodiment of the present disclosure. With reference to step S71 in FIG. 7 and FIG. 8A, a filament fabric 21 is provided. This step includes putting the filament fabric 21 onto a hole conveyor belt C by using a conveying wheel S.

In some embodiments, the filament fabric 21 is woven by using TPU filaments, and the weaving method can be warp knitting, weft knitting, knitting, or tatting.

Figure 8A:
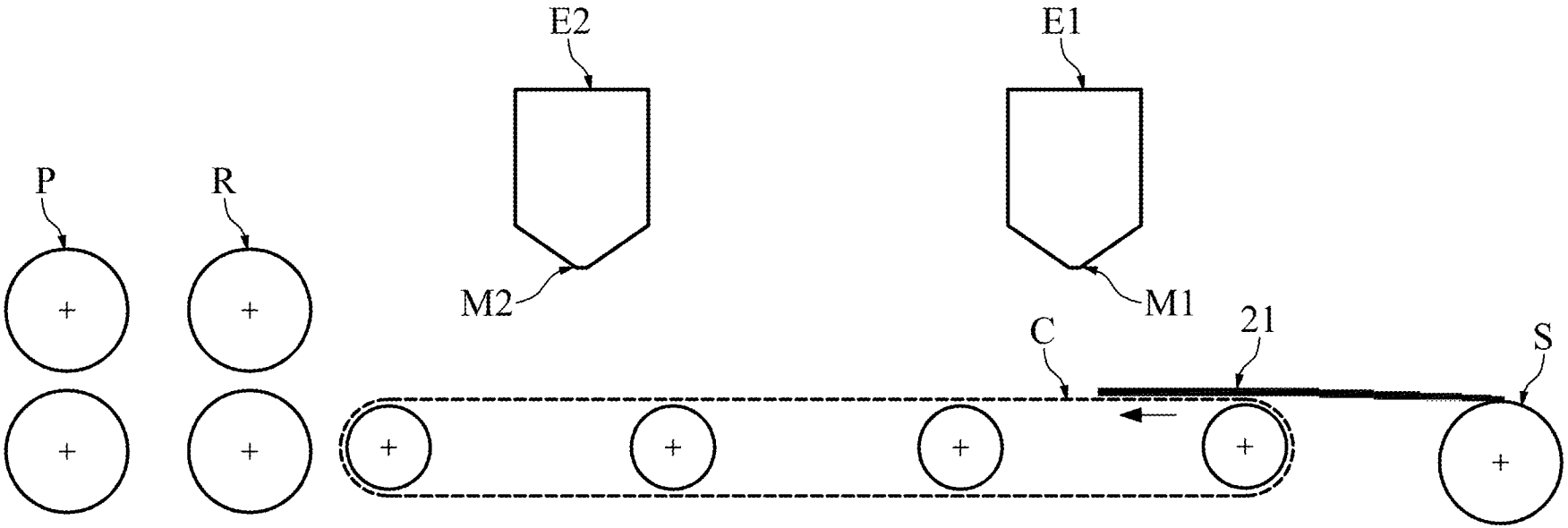
FIGS. 8A to 8E are schematic views respectively showing respective steps in a manufacturing method of an environmental-friendly artificial leather according to a second embodiment of the present disclosure.
Figure 8B:
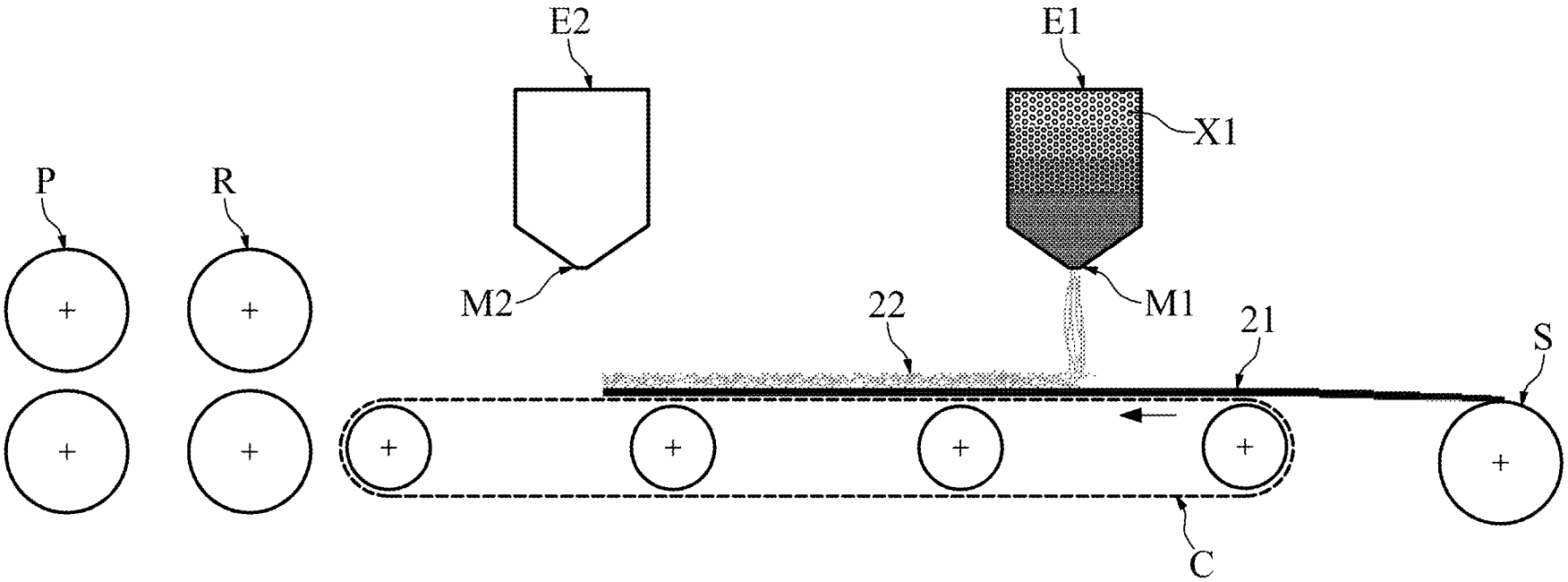

With reference to step S72 in FIG. 7 and FIG. 8B, a first fiber web 22 is meltblown on the filament fabric 21. In some embodiments, the step of meltblowing the first fiber web 22 includes the following steps.

Step 1: Put TPU particles X1 into an extruder E1 for melting, and blow the melted TPU out by using a meltblown die head M1 and pressurized air, to form TPU fibers. Preferably, the temperature of the meltblown die head M1 is 210 to 250° C., and the air pressure and the air temperature of the pressurized air are respectively 3 to 8 kgf/cm$^2$ and 210 to 240° C.

Step 2: Pile up the TPU fibers into a web by using the hole conveyor belt C, and release high-speed wind pressure by using the hole conveyor belt C, to form the first fiber web 22.

Figure 8C:
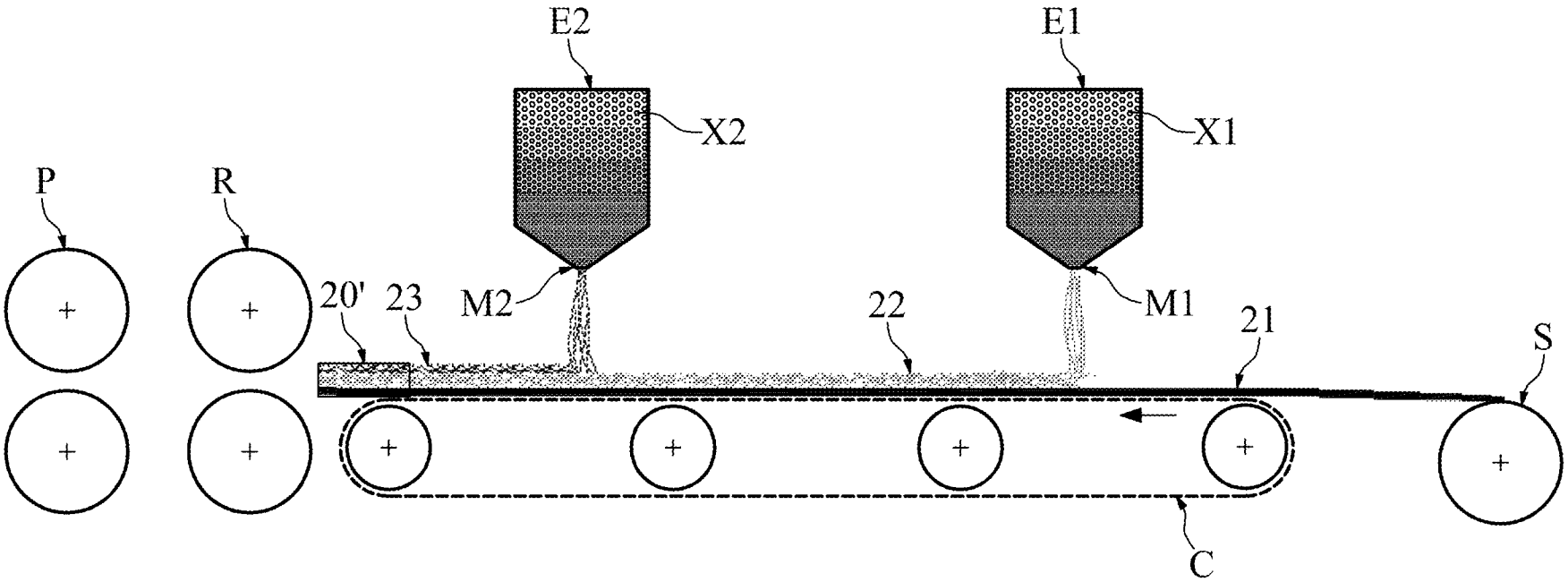

With reference to step S73 in FIG. 7 and FIG. 8C, a second fiber web 23 is meltblown on the first fiber web 22 to form a multilayer fiber structure 20'. In some embodiments, the step of meltblowing the second fiber web 23 includes the following steps.

Step 1: Put TPU particles X2 into an extruder E2 for melting, and blow the melted TPU out by using a meltblown die head M2 and pressurized air, to form TPU fibers. Preferably, the temperature of the meltblown die head M2 is 220 to 260° C., and the air pressure and the air temperature of the pressurized air are respectively 3 to 8 kgf/cm$^2$ and 220 to 250° C.

Step 2: Pile up the TPU fibers into a web by using the hole conveyor belt C, and release high-speed wind pressure by using the hole conveyor belt C, to form the second fiber web 23.

Figure 8D:
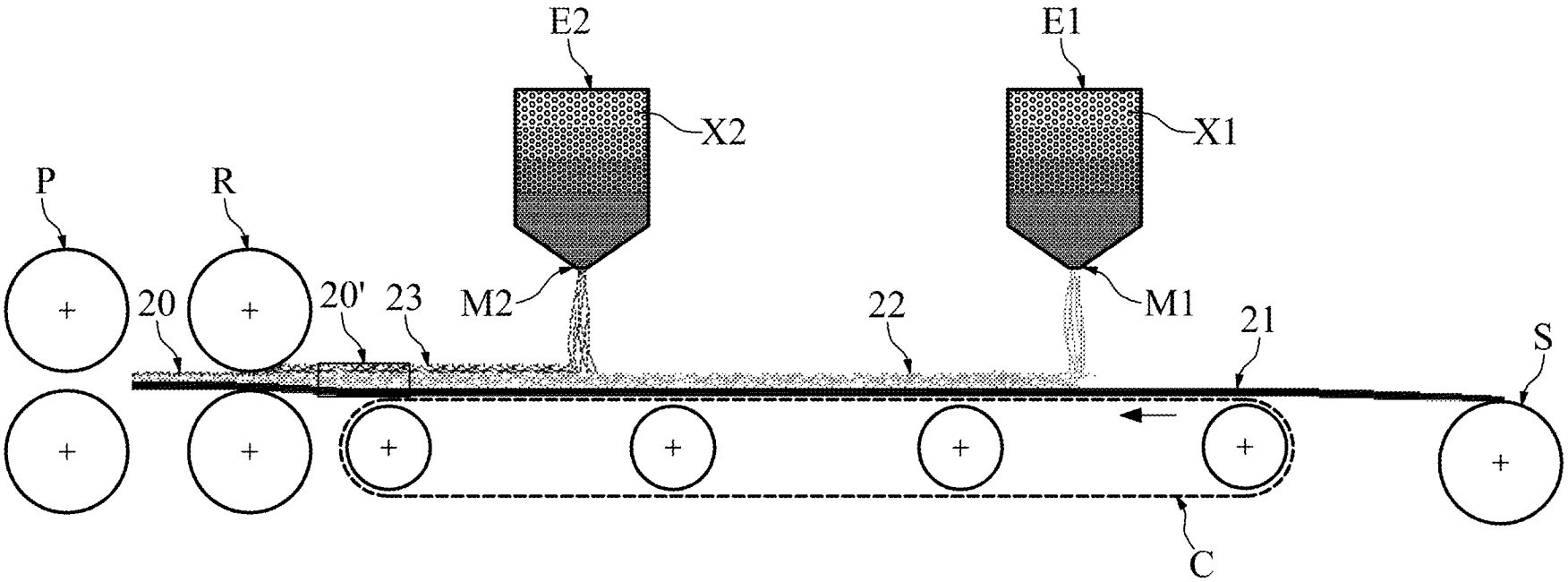

With reference to step S74 in FIG. 7 and FIG. 8D, the multilayer fiber structure 20' is heat pressed to form the environmental-friendly artificial leather 20. This step includes heat pressing the multilayer fiber structure 20' by using a heat pressing wheel R, and preferably, the temperature of the heat pressing wheel R is 130 to 160° C.

Figure 8E:
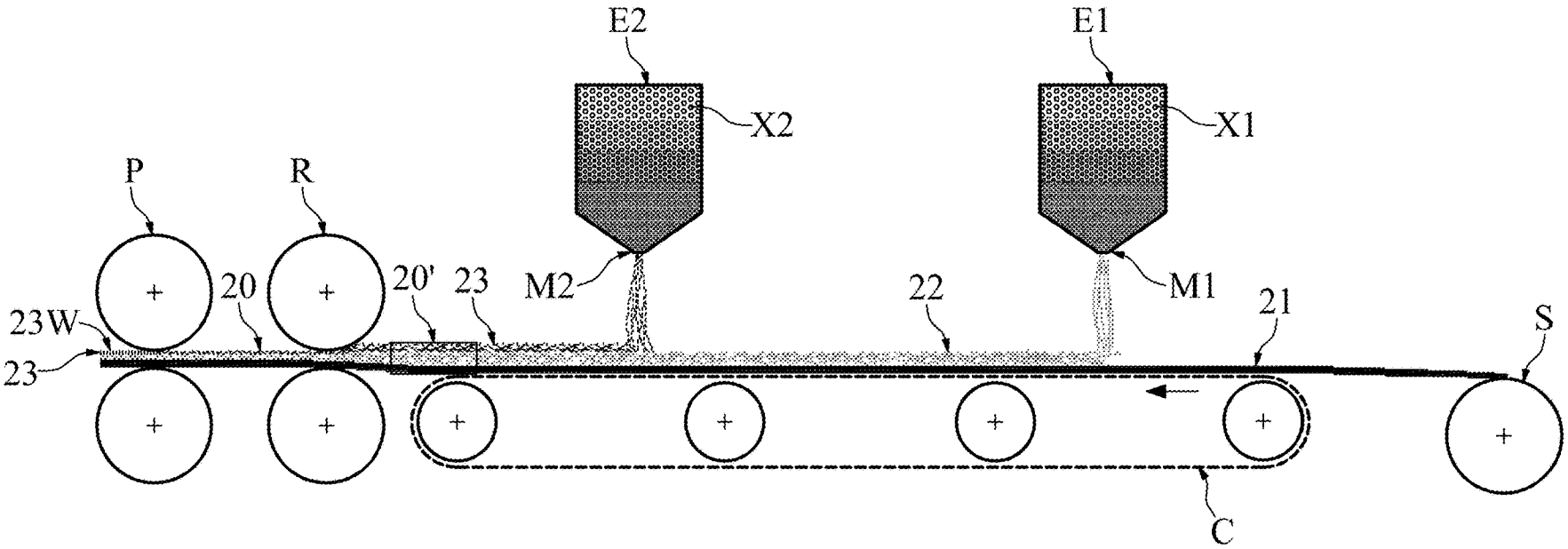

Referring to FIG. 8E, after the environmental-friendly artificial leather 20 is manufactured, surface grinding can be performed on the second fiber web 23 of the environmental-friendly artificial leather 20 by using a grinding machine P, so that the fibers of the second fiber web 23 locally break to form the teasing structure 23W, and the environmental-friendly artificial leather 20 delivers the hand feel of the teasing leather.

In the present disclosure, the environmental-friendly artificial leather can be manufactured by using a single meltblown process, greatly simplifying a manufacturing process for an artificial leather, and no solvent is used in the meltblown process, thereby meeting a requirement for environmental protection. Furthermore, the first fiber web, the second fiber web, and the filament fabric all use the TPU, and the TPU is an environmental-friendly material that does not contain a solvent, and is recyclable. Moreover, in the present disclosure, the filament fabric is sandwiched between the first fiber web and the second fiber web, or a fiber web is integrated with the filament fabric through meltblown, so that the physical properties of the environmental-friendly artificial leather can be greatly improved.

The present disclosure is illustrated in detail with the following embodiments, but it does not mean that the present disclosure is only limited to the content disclosed by these embodiments.

Embodiment 1

With reference to FIGS. 4A to 4E, TPU particles whose melting point is 180° C. and whose Shore hardness is 70A are put into an extruder E1 for melting, and the temperature is set to 120° C., 190° C., 210° C., and 220° C. successively from a feed area to a discharge area. Then the melted TPU is delivered into a meltblown die head M1, and the temperature of the meltblown die head M1 is 235° C. In addition, pressurized air is connected to the meltblown die head M1, and the air pressure of the pressurized air is 6 kgf/cm$^2$; meanwhile, the air is heated, the heating temperature is 220° C., and then the heated air is delivered into the meltblown die head M1. When the air is blown out, the melted TPU is blown out at the same time, to form TPU fibers. Then, the TPU fibers are piled up into a web by using a hole conveyor belt C, and release high-speed wind pressure by using the hole conveyor belt C, to form a first fiber web.

A warp knitted fabric obtained through mixed weaving of 75 denier TPU filaments and 150 denier TPU filaments is put on the first fiber web.

TPU particles whose melting point is 183° C. and whose Shore hardness is 85A are put into an extruder E2 for melting, and the temperature is set to 100° C., 190° C., 220° C., and 230° C. successively from a feed area to a discharge area. Then the melted TPU is delivered into a meltblown die head M2, and the temperature of the meltblown die head M2 is 235° C. In addition, pressurized air is connected to the meltblown die head M2, and the air pressure of the pressurized air is 6 kgf/cm$^2$; meanwhile, the air is heated, the heating temperature is 220° C., and then the heated air is delivered into the meltblown die head M2. When the air is blown out, the melted TPU is blown out at the same time, to form TPU fibers. Then, the TPU fibers are piled up into a web by using a hole conveyor belt C, and release high-speed wind pressure by using the hole conveyor belt C, to form a second fiber web; and the second fiber web covers the warp knitted fabric.

The foregoing three-layer fiber structure is heat pressed by using a heat pressing wheel whose temperature is 145° C., to control the thickness and the flatness.

After surface grinding is performed on the second fiber web by using an 80 mesh/200 mesh grinding machine, an environmental-friendly artificial leather with teasing, high physical properties, and a thickness of 1.1 mm can be manufactured, and the manufactured environmental-friendly artificial leather has the following physical properties: weight (ASTM D751): 463 g/m2; tensile strength (ASTM D1682): 38 kg/inch; elongation at break (ASTM D1682): 60%; tearing strength (ASTM D2262): 8.5 Kg.

Embodiment 2

With reference to FIGS. 4A to 4E, TPU particles whose melting point is 183° C. and whose Shore hardness is 85A are put into an extruder E1 for melting, and the temperature is set to 105° C., 192° C., 222° C., and 235° C. successively from a feed area to a discharge area. Then the melted TPU is delivered into a meltblown die head M1, and the temperature of the meltblown die head M1 is 240° C. In addition, pressurized air is connected to the meltblown die head M1, and the air pressure of the pressurized air is 7.2 kgf/cm$^2$; meanwhile, the air is heated, the heating temperature is 228° C., and then the heated air is delivered into the meltblown die head M1. When the air is blown out, the melted TPU is blown out at the same time, to form TPU fibers. Then, the TPU fibers are piled up into a web by using a hole conveyor belt C, and release high-speed wind pressure by using the hole conveyor belt C, to form a first fiber web.

A tatted fabric obtained through weaving of 300 denier TPU filaments is put on the first fiber web.

The TPU particles stated above are put into an extruder E2 for melting, and the temperature is set to 105° C., 192° C., 222° C., and 235° C. successively from a feed area to a discharge area. Then the melted TPU is delivered into a meltblown die head M2, and the temperature of the meltblown die head M2 is 240° C. In addition, pressurized air is connected to the meltblown die head M2, and the air pressure of the pressurized air is 7.2 kgf/cm$^2$; meanwhile, the air is heated, the heating temperature is 228° C., and then the heated air is delivered into the meltblown die head M2. When the air is blown out, the melted TPU is blown out at the same time, to form TPU fibers. Then, the TPU fibers are piled up into a web by using a hole conveyor belt C, and release high-speed wind pressure by using the hole conveyor belt C, to form a second fiber web; and the second fiber web covers the tatted fabric.

The foregoing three-layer fiber structure is heat pressed by using a heat pressing wheel whose temperature is 152° C., to control the thickness and the flatness.

After surface grinding is performed on the second fiber web by using an 80 mesh/160 mesh/400 mesh grinding machine, an environmental-friendly artificial leather with teasing, high physical properties, and a thickness of 0.7 mm can be manufactured, and the manufactured environmental-friendly artificial leather has the following physical properties: weight (ASTM D751): 411 g/m2; tensile strength (ASTM D1682): 32 kg/inch; elongation at break (ASTM D1682): 40%; tearing strength (ASTM D2262): 7.6 Kg.

Embodiment 3

With reference to FIGS. 4A to 4E, TPU particles whose melting point is 180° C. and whose Shore hardness is 70A are put into an extruder E1 for melting, and the temperature is set to 115° C., 188° C., 205° C., and 215° C. successively from a feed area to a discharge area. Then the melted TPU is delivered into a meltblown die head M1, and the temperature of the meltblown die head M1 is 230° C. In addition, pressurized air is connected to the meltblown die head M1, and the air pressure of the pressurized air is 6.3 kgf/cm$^2$; meanwhile, the air is heated, the heating temperature is 220° C., and then the heated air is delivered into the meltblown die head M1. When the air is blown out, the melted TPU is blown out at the same time, to form TPU fibers. Then, the TPU fibers are piled up into a web by using a hole conveyor belt C, and release high-speed wind pressure by using the hole conveyor belt C, to form a first fiber web.

A warp knitted fabric obtained through mixed weaving of 150 denier TPU filaments and 150 denier TPU monofilaments is put on the first fiber web.

TPU particles whose melting point is 183° C. and whose Shore hardness is 85A are put into an extruder E2 for melting, and the temperature is set to 100° C., 190° C., 220° C., and 230° C. successively from a feed area to a discharge area. Then the melted TPU is delivered into a meltblown die head M2, and the temperature of the meltblown die head M2 is 230° C. In addition, pressurized air is connected to the meltblown die head M2, and the air pressure of the pressurized air is 6.3 kgf/cm$^2$; meanwhile, the air is heated, the heating temperature is 220° C., and then the heated air is delivered into the meltblown die head M2. When the air is blown out, the melted TPU is blown out at the same time, to form TPU fibers. Then, the TPU fibers are piled up into a web by using a hole conveyor belt C, and release high-speed wind pressure by using the hole conveyor belt C, to form a second fiber web; and the second fiber web covers the warp knitted fabric.

The foregoing three-layer fiber structure is heat pressed by using a heat pressing wheel whose temperature is 145° C., to control the thickness and the flatness.

After surface grinding is performed on the second fiber web by using an 80 mesh/200 mesh grinding machine, an environmental-friendly artificial leather with teasing, high physical properties, and a thickness of 1.1 mm can be manufactured, and the manufactured environmental-friendly artificial leather has the following physical properties: weight (ASTM D751): 426 g/m2; tensile strength (ASTM D1682): 26 kg/inch; elongation at break (ASTM D1682): 65%; tearing strength (ASTM D2262): 7.2 Kg.

Embodiment 4

With reference to FIGS. 8A to 8E, a round knitted fabric obtained through mixed weaving of 75 denier/24 F TPU filaments and 150 denier/48 F TPU filaments is used as a carrier, and is put on a hole conveyor belt C.

TPU particles whose melting point is 160° C. and whose Shore hardness is 50A are put into an extruder E1 for melting, and the temperature is set to 105° C., 175° C., 195° C., and 195° C. successively from a feed area to a discharge area. Then the melted TPU is delivered into a meltblown die head M1, and the temperature of the meltblown die head M1 is 220° C. In addition, pressurized air is connected to the meltblown die head M1, and the air pressure of the pressurized air is 8 kgf/cm$^2$; meanwhile, the air is heated, the heating temperature is 230° C., and then the heated air is delivered into the meltblown die head M1. When the air is blown out, the melted TPU is blown out at the same time, to form TPU fibers, and the TPU fibers are blown onto the round knitted fabric, to form a first fiber web.

TPU particles whose melting point is 180° C. and whose Shore hardness is 70A are put into an extruder E2 for melting, and the temperature is set to 125° C., 195° C., 225° C., and 235° C. successively from a feed area to a discharge area. Then the melted TPU is delivered into a meltblown die head M2, and the temperature of the meltblown die head M2 is 240° C. In addition, pressurized air is connected to the meltblown die head M2, and the air pressure of the pressurized air is 8 kgf/cm$^2$; meanwhile, the air is heated, the heating temperature is 250° C., and then the heated air is delivered into the meltblown die head M2. When the air is blown out, the melted TPU is blown out at the same time, to form TPU fibers, and the TPU fibers are blown onto the first fiber web, to form a second fiber web.

The foregoing three-layer fiber structure is heat pressed by using a heat pressing wheel whose temperature is 145° C., to control the thickness and the flatness.

After surface grinding is performed on the second fiber web by using an 160 mesh/320 mesh/800 mesh grinding machine, an environmental-friendly artificial leather with teasing, high physical properties, and a thickness of 0.5 mm can be manufactured, and the manufactured environmental-friendly artificial leather has the following physical properties: weight (ASTM D751): 340 g/m2; tensile strength (ASTM D1682): 25 kg/inch; elongation at break (ASTM D1682): 70%; tearing strength (ASTM D2262): 6.3 Kg.

The physical property data of the environmental-friendly artificial leathers of the Embodiments 1~4 are summarized in Table 1, and is compared with the physical property data of the conventional artificial leathers of Table 2. It can be found that the tearing strength of the environmental-friendly artificial leathers of the Embodiments 1~4 is better than that of the conventional artificial leathers. Embodiments 1~4 can manufacture the environmental-friendly artificial leathers by using a single meltblown process, and the manufacturing process thereof is more simplified than the conventional artificial leather manufactured by using a plurality of different processes.

TABLE 1

Physical property data of the environmental-friendly artificial leathers of the Embodiments 1-4.

| physical properties | Embodiment 1 | Embodiment 2 | Embodiment 3 | Embodiment 4 |
|---|---|---|---|---|
| thickness (mm) | 1.1 | 0.7 | 1.1 | 0.5 |
| weight (g/m2) | 463 | 411 | 426 | 340 |
| tensile strength (kg/inch) | 38 | 32 | 26 | 25 |
| elongation at break (%) | 60 | 40 | 65 | 70 |
| tearing strength (Kg) | 8.5 | 7.6 | 7.2 | 6.3 |

TABLE 2

Physical property data of the conventional artificial leathers.

| physical properties | Conventional artificial leather 1 | Conventional artificial leather 2 | Conventional micro-fiber artificial leather 1 | Conventional micro-fiber artificial leather 2 | Conventional micro-fiber Suede artificial leather |
|---|---|---|---|---|---|
| thickness (mm) | 0.7 | 1.1 | 0.7 | 1.1 | 0.7 |
| weight (g/m2) | 400 | 480 | 400 | 550 | 280 |
| tensile strength (kg/inch) | 20 | 25 | 27.5 | 30 | 12 |
| elongation at break (%) | 60-100 | 60-100 | 100-170 | 100-160 | 100 |
| tearing strength (Kg) | 4 | 4.5 | 5.5 | 6.25 | 4.2 |

Moreover, the scope of the present application is not intended to be limited to the particular embodiments of the process, machine, manufacture, and composition of matter, means, methods and steps described in the specification. As those skilled in the art will readily appreciate form the present disclosure, processes, machines, manufacture, compositions of matter, means, methods, or steps, presently existing or later to be developed, that perform substantially the same function or achieve substantially the same result as the corresponding embodiments described herein may be utilized in accordance with some embodiments of the present disclosure.

Accordingly, the appended claims are intended to include within their scope such processes, machines, manufacture, and compositions of matter, means, methods or steps. In addition, each claim constitutes a separate embodiment, and the combination of various claims and embodiments are within the scope of the invention.

What is claimed is:

1. A manufacturing method of an artificial leather, comprising:

meltblowing a first fiber web, wherein the step of meltblowing the first fiber web comprises the following steps:

putting thermoplastic polyurethane (TPU) particles into an extruder for melting, and blowing the melted TPU out by using a meltblown die head and pressurized air, to form TPU fibers, wherein the air pressure and the air temperature of the pressurized air are respectively 3 to 8 kgf/cm$^2$ and 210 to 240° C.; and piling up the TPU fibers into a web by using a hole conveyor belt, and releasing high-speed wind pressure by using the hole conveyor belt, to form the first fiber web;

disposing a filament fabric on the first fiber web;

meltblowing a second fiber web on the filament fabric to form a multilayer fiber structure; and heat pressing the multilayer fiber structure to form the artificial leather.

2. The manufacturing method of claim 1, wherein the step of meltblowing the second fiber web comprises the following steps:

putting thermoplastic polyurethane (TPU) particles into an extruder for melting, and blowing the melted TPU out by using a meltblown die head and pressurized air, to form TPU fibers; and piling up the TPU fibers into a web on the filament fabric by using the hole conveyor belt, and releasing high-speed wind pressure by using the hole conveyor belt, to form the second fiber web.

3. A manufacturing method of an artificial leather, comprising:

providing a filament fabric;

meltblowing a first fiber web on the filament fabric, wherein the step of meltblowing the first fiber web comprises the following steps:

putting thermoplastic polyurethane (TPU) particles into an extruder for melting, and blowing the melted TPU out by using a meltblown die head and pressurized air, to form TPU fibers, wherein the air pressure and the air temperature of the pressurized air are respectively 3 to 8 kgf/cm$^2$ and 210 to 240° C.; and piling up the TPU fibers into a web on the filament fabric by using a hole conveyor belt, and releasing high-speed wind pressure by using the hole conveyor belt, to form the first fiber web;

meltblowing a second fiber web on the first fiber web to form a multilayer fiber structure; and heat pressing the multilayer fiber structure to form the artificial leather.

4. The manufacturing method of claim 3, wherein the step of meltblowing the second fiber web comprises the following steps:

putting thermoplastic polyurethane (TPU) particles into an extruder for melting, and blowing the melted TPU out by using a meltblown die head and pressurized air, to form TPU fibers; and piling up the TPU fibers into a web on the first fiber web by using the hole conveyor belt, and releasing high-speed wind pressure by using the hole conveyor belt, to form the second fiber web.

* * * * *